US007583238B2

(12) United States Patent
Cassen et al.

(10) Patent No.: US 7,583,238 B2
(45) Date of Patent: Sep. 1, 2009

(54) RADOME FOR ENDFIRE ANTENNA ARRAYS

(75) Inventors: John Cassen, Sykesville, MD (US); Timothy G. Waterman, Eldersburg, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 103 days.

(21) Appl. No.: 11/624,726

(22) Filed: Jan. 19, 2007

(65) Prior Publication Data

US 2008/0174510 A1 Jul. 24, 2008

(51) Int. Cl.
*H01Q 1/42* (2006.01)

(52) U.S. Cl. ..... 343/872; 343/753; 343/756; 343/895

(58) Field of Classification Search ..... 343/705, 343/753, 756, 795, 895, 909, 754, 854, 872, 343/778, 846

See application file for complete search history.

(56) References Cited

U.S. PATENT DOCUMENTS

| | | | | |
|---|---|---|---|---|
| 3,396,400 | A | | 8/1968 | Kelly et al. |
| 3,633,206 | A | | 1/1972 | McMillan |
| 3,886,558 | A | | 5/1975 | Cary et al. |
| 4,091,388 | A | | 5/1978 | Fiscus |
| 4,148,039 | A | | 4/1979 | Lunden |
| 4,169,268 | A | | 9/1979 | Schell et al. |
| 4,179,699 | A | | 12/1979 | Lunden |
| 4,477,813 | A | * | 10/1984 | Weiss ..... 343/700 MS |
| 4,506,269 | A | | 3/1985 | Greene |
| 4,835,538 | A | * | 5/1989 | McKenna et al. ..... 343/700 MS |
| 5,126,705 | A | * | 6/1992 | Carnevali et al. ..... 333/128 |
| 5,382,959 | A | * | 1/1995 | Pett et al. ..... 343/700 MS |
| 5,724,052 | A | | 3/1998 | Boulingre et al. |
| 5,861,860 | A | | 1/1999 | Stanek et al. |
| 6,433,753 | B1 | | 8/2002 | Zimmermann |
| 6,483,481 | B1 | * | 11/2002 | Sievenpiper et al. ..... 343/909 |
| 6,552,696 | B1 | * | 4/2003 | Sievenpiper et al. ..... 343/909 |
| 6,600,103 | B1 | | 7/2003 | Schmidt et al. |
| 6,906,674 | B2 | * | 6/2005 | McKinzie et al. ..... 343/767 |
| 6,917,343 | B2 | * | 7/2005 | Sanchez et al. ..... 343/795 |
| 6,982,672 | B2 | * | 1/2006 | Lin et al. ..... 343/700 MS |
| 6,992,635 | B2 | * | 1/2006 | Nishiyama et al. .... 343/700 MS |
| 2003/0034933 | A1 | | 2/2003 | Frenkel |
| 2003/0052810 | A1 | | 3/2003 | Artis et al. |

* cited by examiner

*Primary Examiner*—Douglas W. Owens
*Assistant Examiner*—Chuc Tran
(74) *Attorney, Agent, or Firm*—Rothwell, Figg, Ernst & Manbeck, P.C.

(57) ABSTRACT

The present invention provides a radome for an endfire antenna array that includes a honeycomb core, an inner skin attached to the honeycomb core, a first set of conductive slats disposed on the inner skin of the honeycomb core and a second set of conductive slats that are disposed within the honeycomb core. The two sets of conductive slats are capacitively-coupled to one another.

13 Claims, 6 Drawing Sheets

RADOME FOR ENDFIRE ANTENNA ARRAYS

FIELD OF THE INVENTION

The present invention relates to radomes. More particularly, embodiments of the present invention relate to radomes for endfire antenna arrays.

BACKGROUND OF THE INVENTION

Many antenna applications require the installation of a radome over the antenna radiators. For a uniformly, well-constructed radome, the radome material does not significantly effect a broadside antenna's array gain. However, if the radome is located too closely to the radiators of an endfire antenna array, the radome may adversely effect the endfire antenna's array gain. This adverse effect is due, in large part, to the different phase shifts induced in the antenna array's signals by the dielectric effects of the radome material.

FIG. 1 is a schematic diagram of a broadside array 10 having an effective aperture 18. Electromagnetic signals 14, 16 pass through radome 12 substantially perpendicular to the radome's surface, and, while the radome material's dielectric property shifts the phase of the electromagnetic signals 14, 16 to some degree, generally, the phase shift is relatively constant across the effective aperture 18 for all of the signals transmitted or received by broadside array 10. Consequently, the array gain of broadside antenna 10 is not adversely effected by the radome material.

FIG. 2 is a schematic diagram of an endfire array 20 having an effective aperture 28. Electromagnetic signals 24, 26 pass through radome 22 at different incident angles relative to the radome's surface. Consequently, the radome material's dielectric property shifts the phase of electromagnetic signals 24, 26 differently. The phase of electromagnetic signal 26, which passes through more of the radome material, is shifted more that the phase of electromagnetic signal 24, which passes through less of the radome material. Thus, antenna signals propagating to the lower portion of effective aperture 28 will experience larger phase shifts than the antenna signals propagating to the upper portion of the effective aperture 28. For long antennas, the net cumulative shift can be as much as 180 degrees near the lower portion of the effective aperture 28, which causes signals in the endfire aperture 28 to selectively cancel one another.

SUMMARY OF THE INVENTION

Embodiments of the present invention provide a radome for an endfire antenna array that includes a honeycomb core with an inner skin and an outer skin attached thereto, a first set of conductive slats disposed on the inner skin of the honeycomb core and a second set of conductive slats that are disposed within the honeycomb core. The two sets of conductive slats are capacitively-coupled to one another to counteract the adverse effects of the dielectric property of the endfire radome.

BRIEF DESCRIPTION OF THE DRAWINGS

The above and other advantages of this invention will become more apparent by the following description of invention and the accompanying drawings.

DETAILED DESCRIPTION

Embodiments of the present invention provide a radome for an endfire antenna array that includes two sets of conductive slats that counteract the adverse effects of the dielectric property of the radome. One set of conductive slats is located on the inner surface of the radome facing the antenna array, while a second set of conductive slats is located within the body of the radome, adjacent to, and capacitively-coupled to, the first set of conductive slats. The two sets of conductive slats may overlap one another to enhance the capacitive-coupling effect that reduces the phase shift experienced by antenna signals propagating through the radome toward the lower portion of the endfire array's effective aperture. The spaces between the slats in each set advantageously provide transmission windows for antenna signals propagating to the upper portion of the endfire array's effective aperture.

Figure 3:
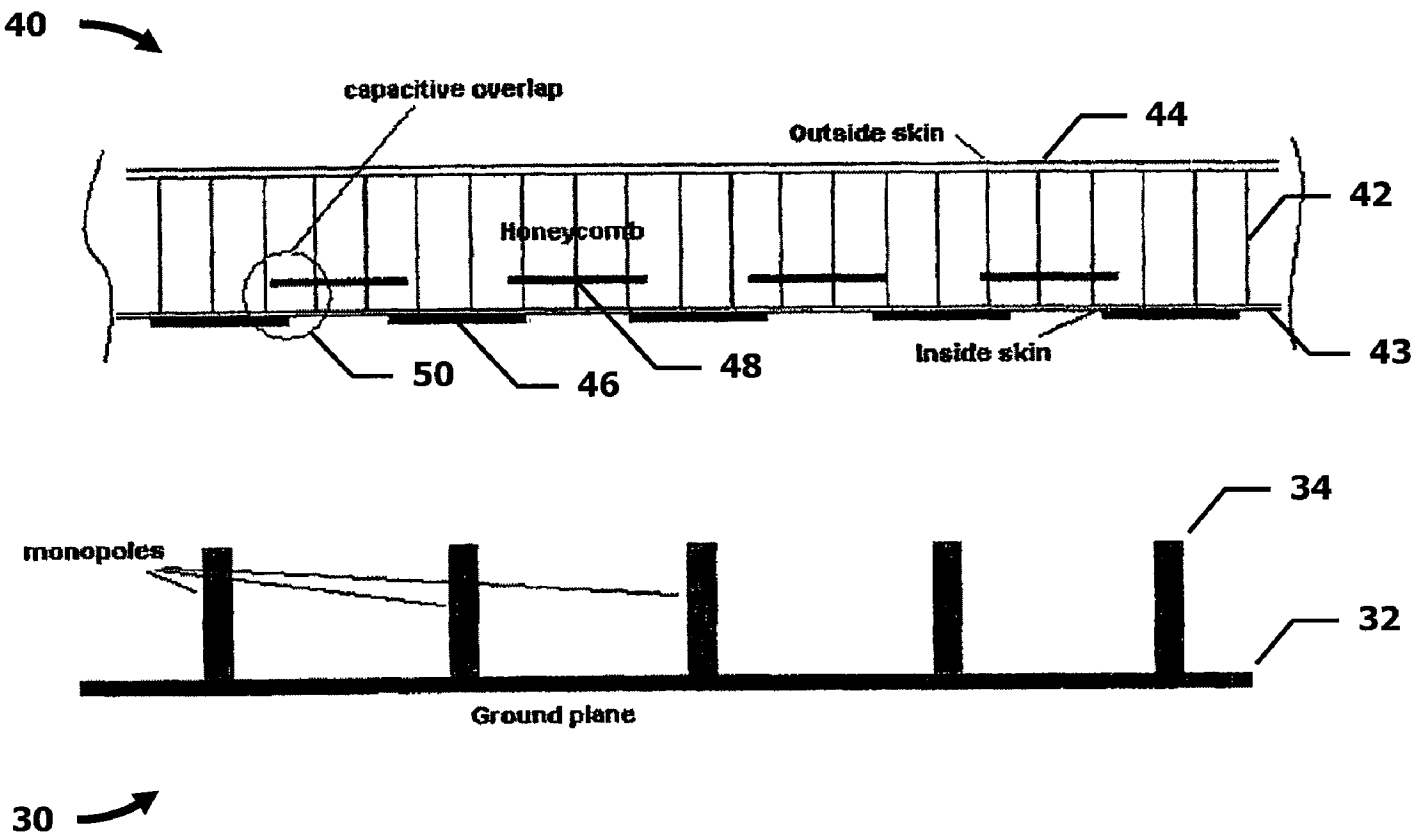
FIG. 3 is a schematic diagram depicting an endfire array and radome in accordance with an embodiment of the present invention.

FIG. 3 is a schematic diagram depicting an endfire array 30 and a radome 40 in accordance with an embodiment of the present invention.

Generally, endfire array 30 includes an array of radiators 34 coupled to a ground plane 32. In the depicted embodiment, endfire array 30 includes a single, linear array of identical monopole radiators 34 coupled to ground plane 32. In order to achieve high gain and narrow beamwidth, the electromagnetic signals received or transmitted by the array of monopole radiators 34 should possess constant amplitude and phase. In alternative embodiments, endfire array 30 may include multiple, linear arrays of monopole radiators 34.

Figure 1:
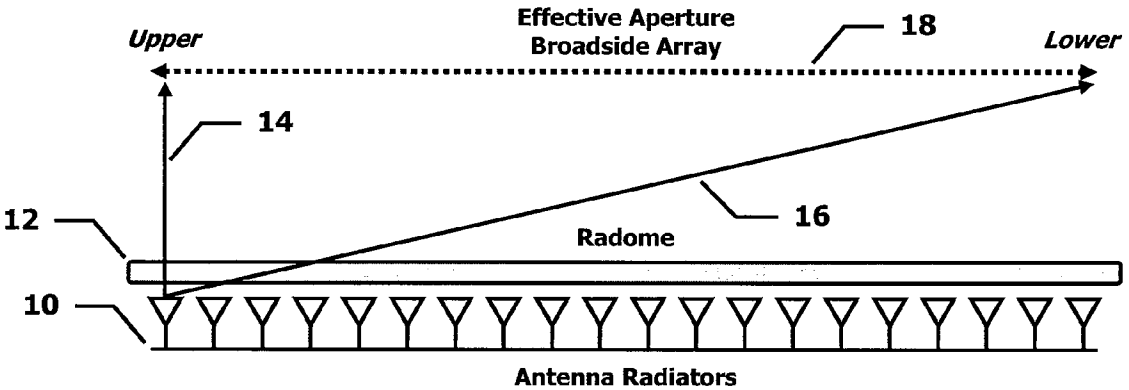
FIG. 1 (prior art)
FIG. 1 is a schematic diagram depicting a prior art broadside array and radome.
Figure 2:
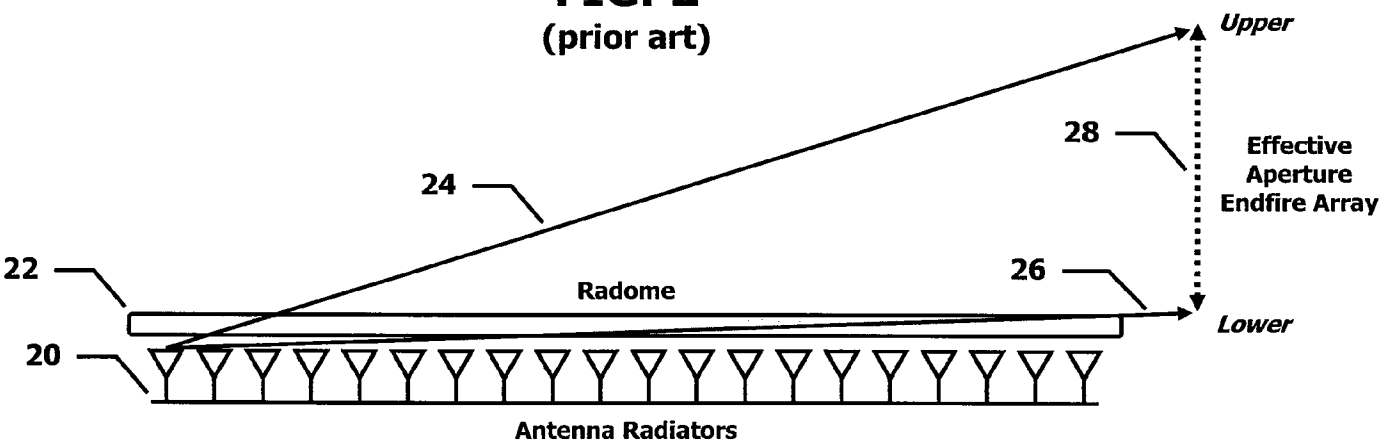
FIG. 2 (prior art)
FIG. 2 is a schematic diagram depicting a prior art endfire array and radome.
Figure 4B:
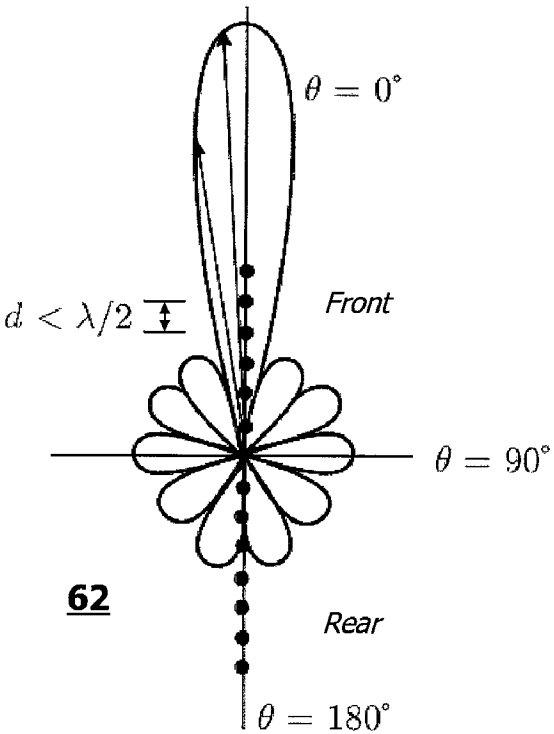
FIGS. 4*a* and 4*b* are depict endfire array beam patterns for two exemplary array element spacings.
Figure 4A:
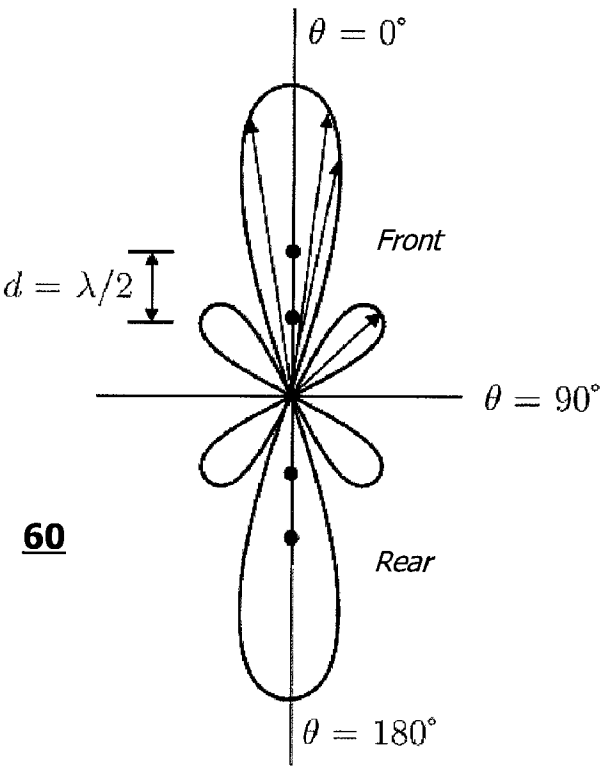

In a preferred embodiment of the linear array, the spacing "d" between each monopole radiator is constant. For an exemplary spacing $d=\lambda/2$, the end fire radiation pattern 60 for a four-element array is depicted in FIG. 4*a*. Due to ambiguity, two main beams are present at 0° and 180°. When the spacing "d" is decreased, however, such that $d<\lambda/2$, the ambiguity may be resolved, resulting in an end fire radiation pattern 62 depicted in FIG. 4*b*. As the beam steer angle for the end-fire array is changed from 0°, i.e., e.g., the lower portion of the endfire array effective aperture (FIG. 2), to 15°, for example, i.e., e.g., the upper portion of the endfire array effective aperture (FIG. 2), the electromagnetic signals propagating to the radiators at the rear of the linear array pass through more of the radome material than electromagnetic signals propagating to the front of the linear array. The additional propagation path through the radome, if uncompensated, induces undesirable phase shifts, as discussed above.

The radome 40 is typically a high-strength, low weight composite structure. In one embodiment, the radome 40 includes a honeycomb core 42 sandwiched between an inner skin or surface 43 and an outer skin or surface 44. The inner and outer skins 43, 44 may be attached to the honeycomb core 42 using, for example, high-strength epoxy. Advantageously, the deleterious effects of radome-induced phase shifts are countered by attaching a first set of conductive slats 46 to the inner skin 43 of the radome 40, and by positioning a second set of conductive slats 48 within the honeycomb core 42 itself, as depicted within FIG. 3. The conductive slats are preferably constructed using highly-conductive material, such as, for example, gold, silver, copper, etc., although other materials may be used.

In a preferred embodiment, the first and second sets of conductive slats 46, 48 are evenly-spaced, while in alternative embodiments, the slat spacing may be non-uniform and based upon other considerations, such as, for example, the distance of the particular spacing to the front of the endfire array. Optionally, the first and second sets of conductive slats 46, 48 may be constructed of dissimilar conductive materials. In one embodiment, the first and second sets of conductive slats 46, 48 overlap at the edges of each respective slat, as depicted in FIG. 3.

The first set of conductive slats 46 prevents a substantial portion of the electromagnetic field from entering the honeycomb core 42, while the second set of conductive slats 48 are positioned, in close proximity to the first set of conductive slats 46, in order to capacitively-couple the first and second sets of conductive slats together. In one sense, the dielectric property of the radome 40 effectively lengthens the electrical path along which the endfire electromagnetic field travels, which induces the undesirable phase shift described above. This effect is countered by the first and second sets of capacitively-coupled slats 46, 48, which effectively shortens the electrical path along which the endfire electromagnetic field travels, which reduces the induced phase shift.

Figure 5:
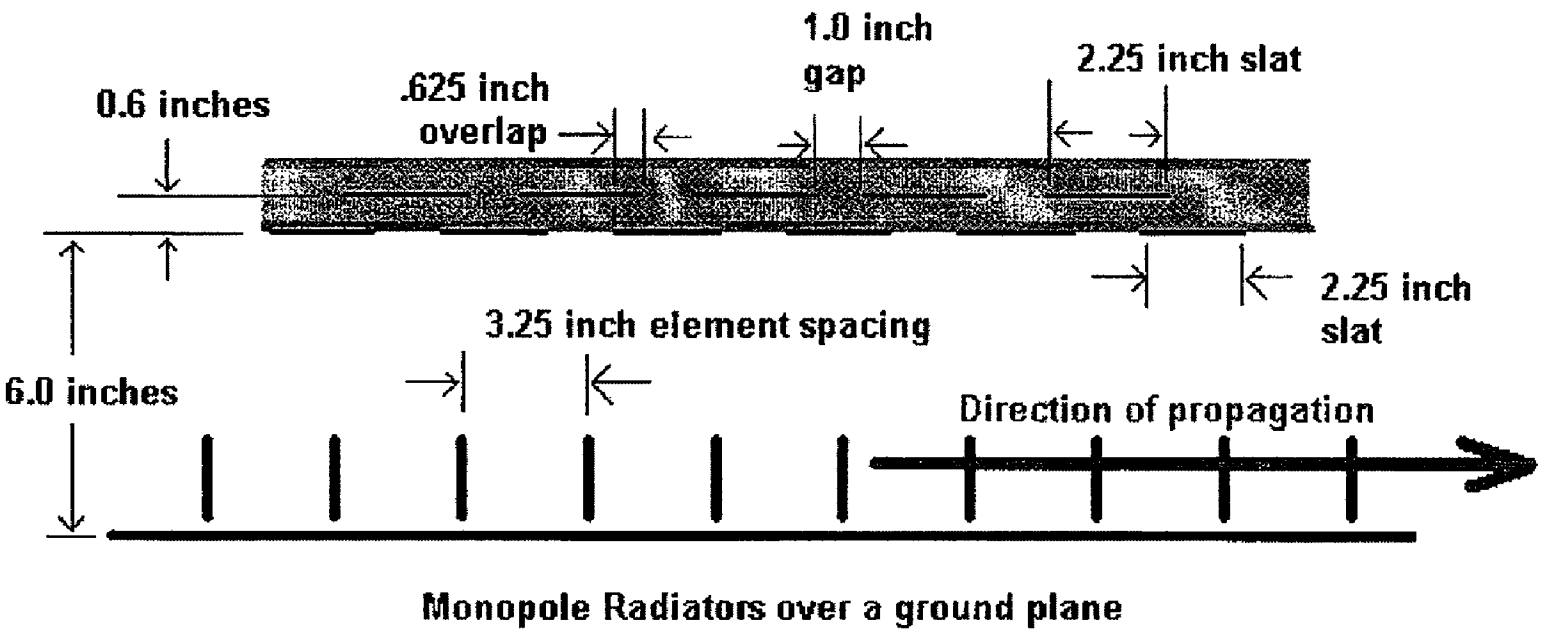
FIG. 5 is a schematic diagram depicting an endfire array and radome in accordance with another embodiment of the present invention.

FIG. 5 is a schematic diagram depicting an endfire array and radome in accordance with an embodiment of the present invention.

In the depicted embodiment, endfire array 30 includes a single, linear array of monopole radiators 34, spaced 3.75 inches apart, which generally supports a frequency range of 1.2 to 1.4 GHz. Radome 40 is positioned 6 inches above the ground plane 32, and includes a fiberglass honeycomb core 42, 0.9 inches in thickness, which is bonded to a fiberglass inner skin 43, 0.063 inches in thickness, and to a fiberglass outer skin 44, 0.063 inches in thickness. The first set of conductive slats 46 include individual slats that are 1 or 2 mils thick, 2.25 inches long, as wide as the antenna width of the antenna and evenly-spaced 1 inch apart. The second set of conductive slats 48 include individual slats that are 1 or 2 mils thick, 2.25 inches long, as wide as the antenna width of the antenna and evenly-spaced 1 inch apart. The second set of conductive slats 48 are positioned 0.6 inches above the first set of conductive slats 46, and the edges of the first and second set of conductive slats overlap by 0.625 inches. The first and second sets of conductive slats are made from a conductive material, such as, for example, aluminum, copper, gold, silver, etc.

Figure 6A:
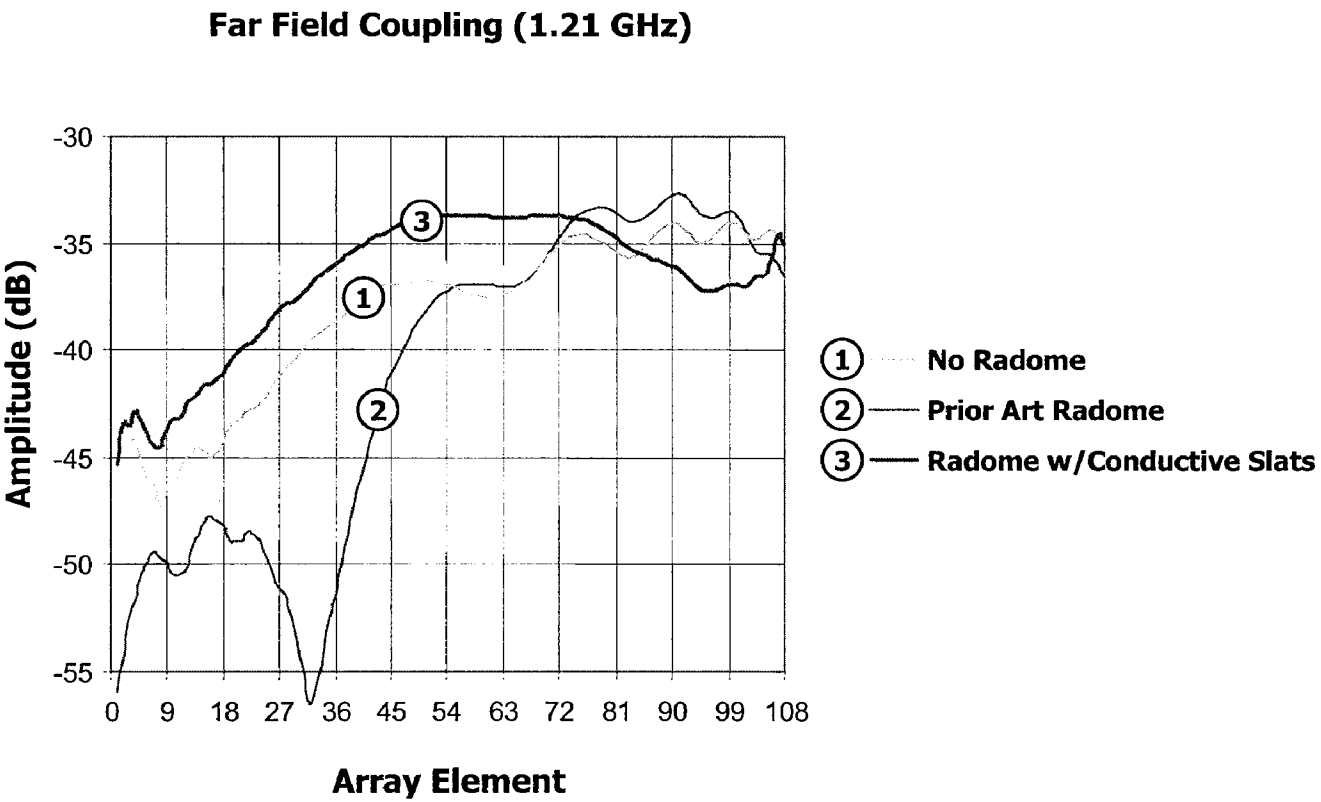
FIGS. 6A and 6B present plots of the improvement in signal amplitude for an endfire and radome in accordance with the embodiment depicted in FIG. 5.
Figure 6B:
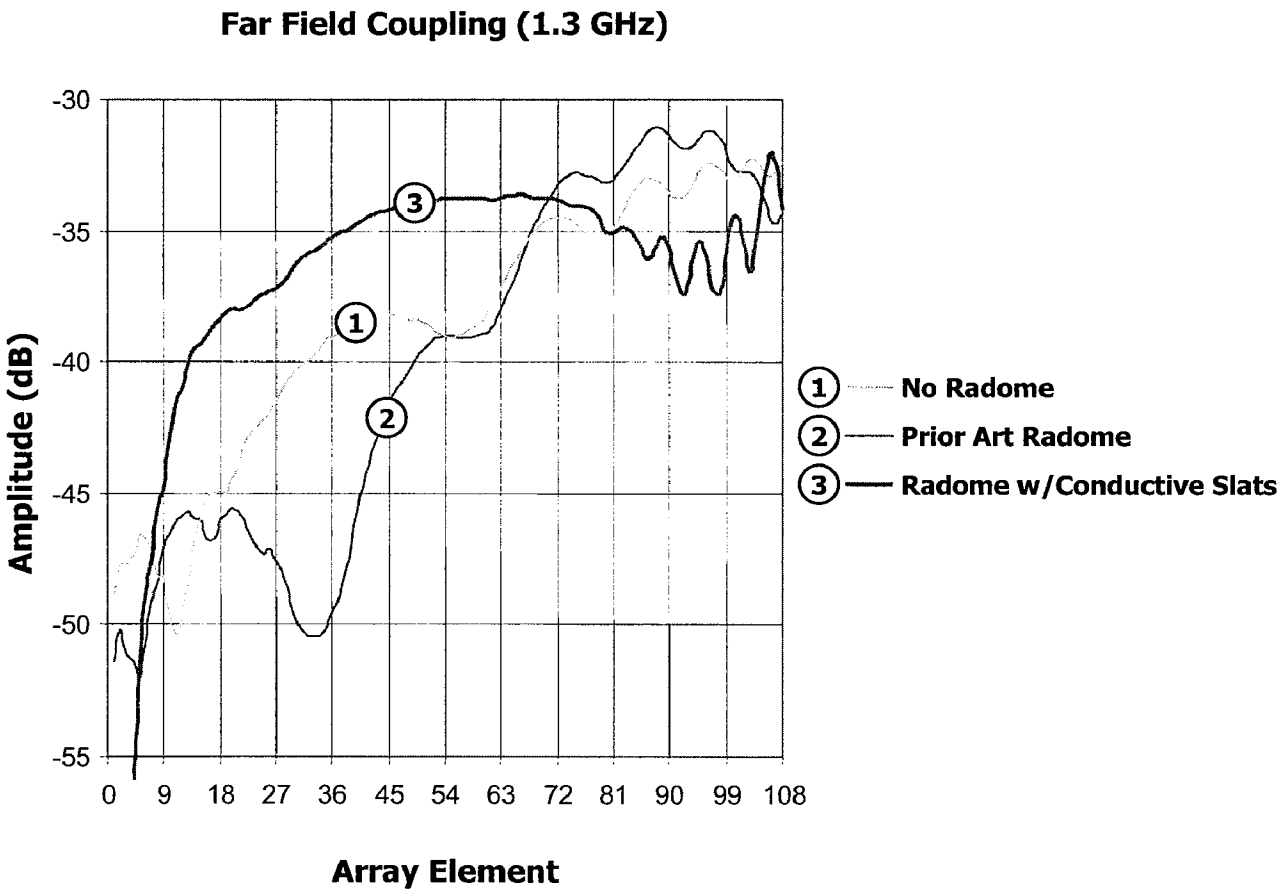

FIG. 6A presents a plot of the improvement in signal amplitude for an endfire array having 108 radiators, at 1.21 GHz and nominal spacing, under three different conditions: the endfire array (curve 1), the endfire array with a prior art radome (curve 2), and the endfire array with radome 40 according to the embodiment depicted in FIG. 5 and described above (curve 3). A comparison of these signal amplitude curves shows the signal cancellation at the far end of the endfire array (i.e., elements 0, 1, 2, etc.) due to the adverse effects of the prior art radome, and the improvements derived from the advantageous effects of the present invention. The most efficient coupling would produce a flat signal response curve. FIG. 6B presents the improvement in signal amplitude at 1.3 GHz.

While this invention has been described in conjunction with specific embodiments thereof, many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein.

What is claimed is:

1. A radome for an endfire antenna array comprising:
a honeycomb core;
an inner skin attached to the honeycomb core;
a first plurality of conductive slats, disposed on the inner skin, arranged to provide a space between each slat; and
a second plurality of conductive slats, disposed within the honeycomb core, arranged to provide a space between each slat and capacitively-coupled to the first plurality of conductive slats, wherein
the first set of conductive slats prevents a substantial portion of an electromagnetic field from passing through the inner skin to the honeycomb core.

2. The radome according to claim 1, wherein the first and second plurality of conductive slats are evenly-spaced.

3. The radome according to claim 1, wherein the first and second plurality of conductive slats overlap at the edges of each respective slat.

4. The radome according to claim 1, wherein the first and second plurality of conductive slats are constructed of dissimilar conductive materials.

5. The radome according to claim 1 wherein the spaces between the first plurality of conductive slats and the spaces between the second plurality of conductive slats form transmission windows to an upper portion of the effective aperture of the endfire array.

6. The radome according to claim 1, further comprising an outer skin attached to the honeycomb core.

7. The radome according to claim 6, wherein the honeycomb core, the inner skin and the outer skin form a composite structure.

8. The radome according to claim 1, wherein the first and second plurality of conductive slats shortens an electrical path through the radome.

9. An endfire antenna system, comprising:
an antenna array; and
a radome spaced from and housing the antenna array, including:
a honeycomb core;
an inner skin attached to the honeycomb core;
a first plurality of conductive slats, disposed on the inner skin, arranged to provide a space between each slat;
a second plurality of conductive slats, disposed within the honeycomb core, arranged to provide a space between each slat and capacitively-coupled to the first plurality of conductive slats,
wherein the first set of conductive slats prevents a substantial portion of an electromagnetic field from passing through the inner skin to the honeycomb core.

10. The radar system of claim 9, wherein the antenna array is a single, linear array of identical, equally-spaced monopole radiators coupled to a ground plane.

11. The radar system of claim 10, wherein a spacing d between each radiator is less than $\lambda/2$.

12. The radar system of claim 10, wherein the radome is positioned approximately 6 inches above the antenna array.

13. The radar system of claim 9, wherein the antenna array includes a plurality of linear arrays of identical, equally-spaced monopole radiators coupled to a ground plane.

* * * * *